US008256432B2

(12) United States Patent
Campagnoli et al.

(10) Patent No.: US 8,256,432 B2
(45) Date of Patent: Sep. 4, 2012

(54) UNIT AND A METHOD FOR WRAPPING TOBACCO PRODUCTS

(75) Inventors: Enrico Campagnoli, Sant'Agata Bolognese (IT); Salvatore Carboni, Bologna (IT); Mario Spatafora, Granarolo (IT)

(73) Assignee: G.D S.p.A. (IT)

( * ) Notice: Subject to any disclaimer, the term of this patent is extended or adjusted under 35 U.S.C. 154(b) by 611 days.

(21) Appl. No.: 12/385,725

(22) Filed: Apr. 17, 2009

(65) Prior Publication Data

US 2009/0260640 A1 Oct. 22, 2009

(30) Foreign Application Priority Data

Apr. 18, 2008 (IT) ..... BO2008A0243

(51) Int. Cl.
*A24C 5/10* (2006.01)

(52) U.S. Cl. ..... 131/58; 53/203; 53/206

(58) Field of Classification Search ..... 131/58; 53/203, 206

See application file for complete search history.

(56) References Cited

FOREIGN PATENT DOCUMENTS

EP 1361158 11/2003

OTHER PUBLICATIONS

European Search Report dated Jul. 16, 2009 from counterpart European patent application.

*Primary Examiner* — Richard Crispino
*Assistant Examiner* — Dionne Walls Mayes
(74) *Attorney, Agent, or Firm* — Timothy J. Klima; Shuttleworth & Ingersoll, PLC

(57) ABSTRACT

Tobacco products are wrapped by a unit equipped with a rotating drum carrying a set of holder mechanisms around the periphery, each rotatable about an axis parallel to the axis of the drum, by which single products are supported and carried through an assembly station together with leaves of wrapping material received from a vacuum roller turning on an axis parallel to the axis of the drum; the vacuum roller revolves tangentially to the drum at the assembly station and comprises a system by which each leaf is transferred to a gripper associated with the support mechanism. The transfer system is timed to operate in a situation of substantially zero relative peripheral velocity between the support mechanism and the vacuum roller.

9 Claims, 4 Drawing Sheets

UNIT AND A METHOD FOR WRAPPING TOBACCO PRODUCTS

BACKGROUND OF THE INVENTION

The present invention relates to a unit, and to a relative method, for wrapping tobacco products.

Wrapping units of the type referred to herein can be utilized in packer machines by which groups of cigarettes, each enveloped previously in an inner wrapper of metal foil paper, are enfolded in packets of soft type.

Another application for such units, for example, is that of machines by which packets of cigarettes are overwrapped, also known as cellophaners.

The wrapping material used by a cigarette packer consists in leaves of a pliable paper, whereas the material used by a cellophaner consists in leaves of a transparent thermoplastic film.

The tobacco products, whether groups of cigarettes or completed packets, will generally present the appearance of a rectangular prism delimited axially by two end faces, and transversely by two larger lateral faces and two smaller lateral faces, or flank faces, extending parallel to a longitudinal axis.

The products are wrapped by a unit of the type in question while advancing along a predetermined feed direction.

To obtain a correctly formed wrap, given the high output speeds at which modern packaging machines are designed to operate, it is indispensable that the leaves of wrapping material be kept continuously and fully under control when fed to the unit and during the wrapping steps, to ensure that they do not become incorrectly positioned and mis-timed relative to the products, as this would result in the finished packet wrapper or overwrap presenting unsightly creases or blemishes.

Wrapping units of conventional type comprise a transfer system by which the aforementioned tobacco products are directed along a predetermined path and through an assembly station where each one is paired with a leaf of wrapping material, consisting of paper in the case of a cigarette packer, and polypropylene in the case of an overwrapper.

The leaf is separated from a continuous strip of wrapping material by a cutting step and fed to the assembly station through the agency of a conveyor that comprises a vacuum roller, set in continuous rotation.

The product transfer system comprises a wrapping wheel set in rotation continuously about an axis parallel to the axis of the vacuum roller, and revolving tangentially to the selfsame roller at the assembly station.

The wrapping wheel is furnished peripherally with a plurality of mechanisms rotatable about corresponding pivots parallel to the axis of the wrapping wheel, each supporting a respective product.

Each of the support mechanisms incorporates a gripper by which one end of a respective leaf of wrapping material, advancing on the vacuum roller, is intercepted at the assembly station.

The transfer of the leaf of material to the mechanism holding a relative product occurs with the jaws of the gripper spread apart in readiness to receive, and is favored by a higher tangential velocity of the vacuum roller.

At the moment when the end or leading edge of the leaf registers in contact with the bottom of the slot afforded by the open gripper, the jaws close and the support mechanism begins to turn on the respective pivot, whereupon the leaf of material will be bent, with the aid also of fixed folding means, and formed gradually into a tubular wrap around the product.

While effective, this conventional wrapping method has been found nonetheless to occasion certain drawbacks, particularly when operating at the high output speeds of modern packaging machines.

It happens frequently that the jaws of the gripper do not close exactly at the moment when the leaf makes contact.

The closing movement of the gripper jaws may be retarded or advanced, but in either case the position assumed by the leaf of wrapping material in relation to the corresponding product will be incorrect, and the wrap consequently defective. Where the closing movement is retarded, moreover, the leaf will be deformed on striking the gripper, and pinched against the bottom of the slot between the jaws.

The object of the present invention is to provide a unit for wrapping tobacco products such as will be able to meet the operating requirements implicit in the foregoing outline, with regard to the high output speeds of modern cigarette packers and cellophaners.

A further object of the invention is to provide a method of wrapping tobacco products such as will be able to meet the operating requirements implicit in the foregoing outline, with regard likewise to the high output speeds of modern machines.

SUMMARY OF THE INVENTION

The stated object is duly realized in a unit for wrapping tobacco products according to the present invention, comprising a rotating drum furnished peripherally with a plurality of mechanisms rotatable about axes parallel to the axis of the drum, by which products are supported and carried through an assembly station together with leaves of wrapping material, a conveyor supplying such leaves, rotatable about an axis parallel to the axis of the drum and revolving substantially tangential to the selfsame drum at the assembly station, and means associated with the rotating conveyor, by which single leaves of material are transferred to each mechanism of the rotating drum.

Advantageously, the tangential velocity of the support mechanisms when passing through the assembly station is substantially the same as the tangential velocity of the rotating conveyor.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
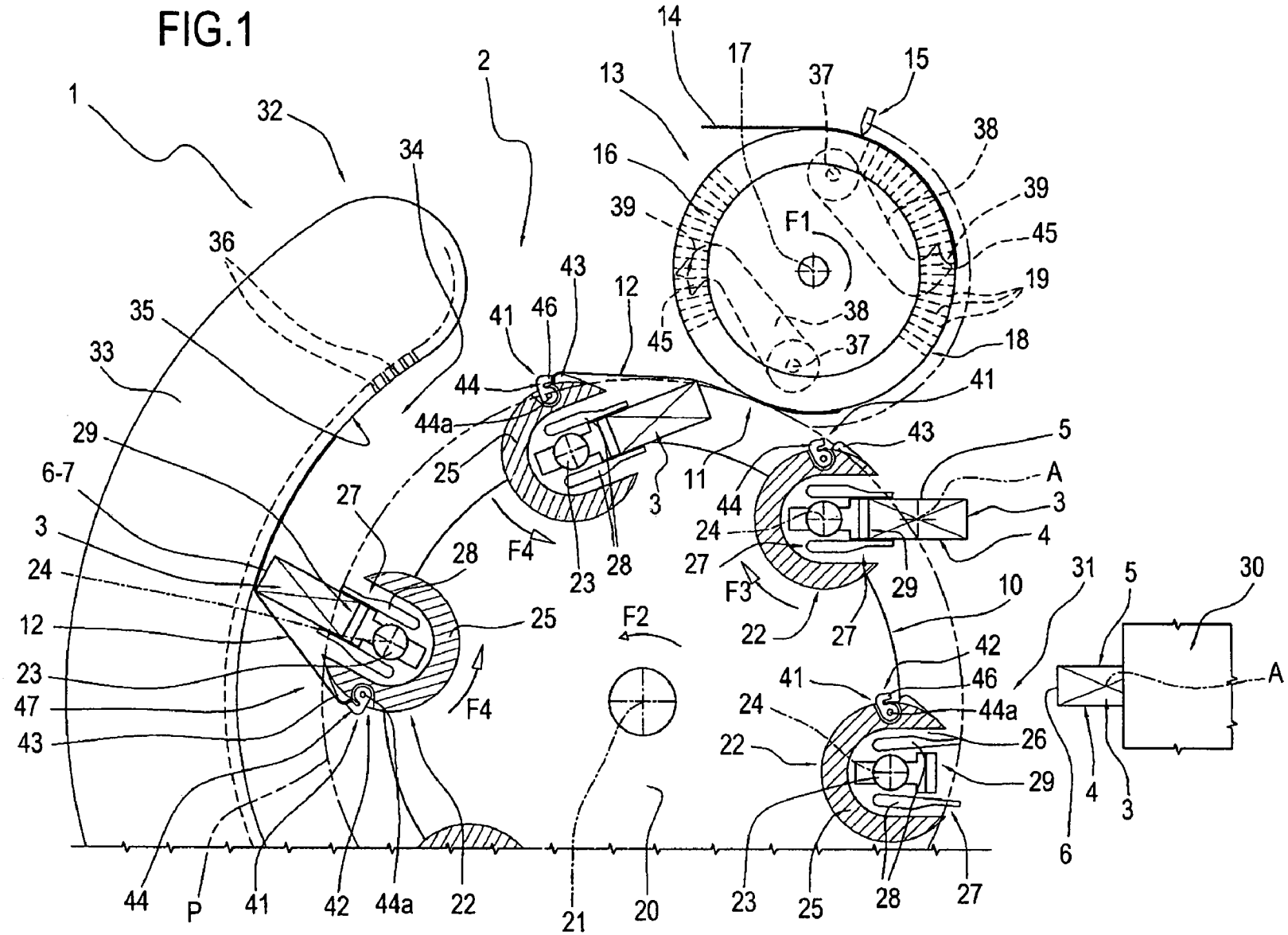
FIGS. 1 and 2 show a portion of an overwrapping machine, viewed schematically in a front elevation with certain parts omitted and comprising a wrapping unit according to the present invention, illustrated in two successive operating steps.
Figure 3:
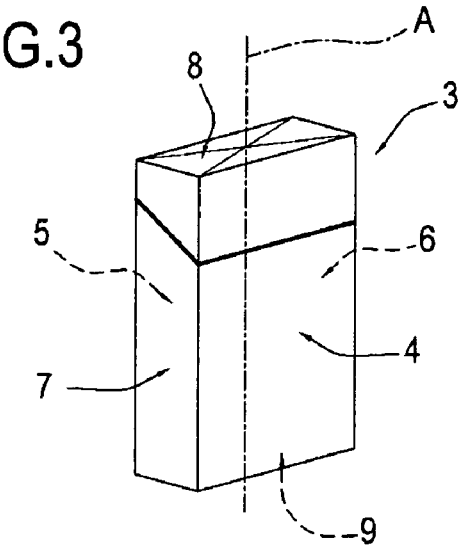
FIG. 3 shows a packet of cigarettes, viewed in perspective, such as would be overwrapped by the unit of FIG. 1.

With reference to FIG. 1, numeral 1 denotes a portion of an overwrapping machine, or cellophaner, comprising a unit 2 for wrapping packets 3 of rectangular parallelepiped geometry, as illustrated in FIG. 3, aligned on a longitudinal axis A and presenting two larger longitudinal walls denoted 4 and 5, also two smaller longitudinal walls or flanks denoted 6 and 7, and two end walls or end faces disposed transversely to the longitudinal axis A, denoted 8 and 9.

The unit 2 comprises transfer means 10 by which the packets 3 are directed along a feed path P and through an assembly station 11 where a leaf 12 of wrapping material (generally polypropylene) is paired with each packet 3.

The aforementioned leaves 12 of material are fed to the assembly station 11 by a conveyor 13 such as will cause a continuous strip 14 of material to decoil from a roll (not illustrated) and advance toward a cutting device, shown schematically as a blade 15, by which the selfsame material is divided into single leaves 12 and carried thus by the conveyor 13 along the feed path P toward the assembly station 11.

The conveyor 13 comprises a hollow vacuum roller 16 set in rotation continuously about a relative axis 17 in a direction indicated by the arrow denoted F1.

The tubular wall 18 of the roller 16 presents a plurality of through holes 19 connected to a source of negative pressure (not illustrated).

Accordingly, both the free end of the strip 14, and the leaves 12 cut from the strip, are retained by suction on the cylindrical surface presented by the tubular wall 18 of the roller 16. In addition, the leaves 12 separated by the cutting device 15 will also be spaced apart at a predetermined distance one from the next.

The aforementioned transfer means 10 comprise a wrapping wheel, consisting in a drum 20 positioned substantially tangential to the roller 16 and set in rotation continuously about an axis 21 parallel to the axis 17 of the selfsame roller, in a direction indicated by the arrow denoted F2.

The drum 20 is furnished peripherally with a plurality of mechanisms 22 equispaced angularly and mounted freely to respective pivots 23 of which the axes 24 lie parallel to the axis 21 of the drum.

Each mechanism 22 comprises a hollow cylindrical body 25, aligned concentrically on the respective pivot 23 and affording an axial lateral opening 26.

The cylindrical body 25 of each mechanism 22 houses gripping means 27, appearing as two substantially radial jaws 28, mounted freely on pivots disposed parallel to the aforementioned axis 24 and creating a slot 29 within the axial lateral opening 26 such as will accommodate a packet 3 disposed with its longitudinal axis A lying parallel to the axis 24 of the mechanism, and with the larger side walls 4 and 5 offered in contact to the two jaws 28.

With the drum 20 set in rotation, each mechanism 22 is made to pivot on its axis 24 through the agency of conventional actuator means (not illustrated), in a manner shortly to be described.

The block denoted 30 represents a feed unit by which packets 3 are directed into the slot 29 of each mechanism 22 at an infeed position 31 lying upstream of the assembly station 11, considered relative to the direction of rotation F2 of the drum 20.

Located downstream of the assembly station 11, likewise relative to the direction of rotation F2 of the drum 20, are fixed folding means 32 comprising a plate or mantle 33 that combines with the drum 20 to create a channel 34 centered on the axis 21 of the selfsame drum and extending as far as a station (not illustrated) where the packets 3 are released.

The cylindrical surface 35 of the mantle 33 directed toward the drum 20 presents a plurality of suction holes 36, uniformly distributed over the selfsame surface.

As illustrated to advantage in FIG. 4, the vacuum roller 16 carries two diametrically opposed pivots 37 located internally of the tubular wall 18, with axes parallel to the axis 17 of the roller, each providing a fulcrum point for one end of an L-shaped arm 38 of which the free end 39 rides in close proximity to a plurality of openings 40 presented by the tubular wall 18, as will be made clear in due course.

Figure 2:
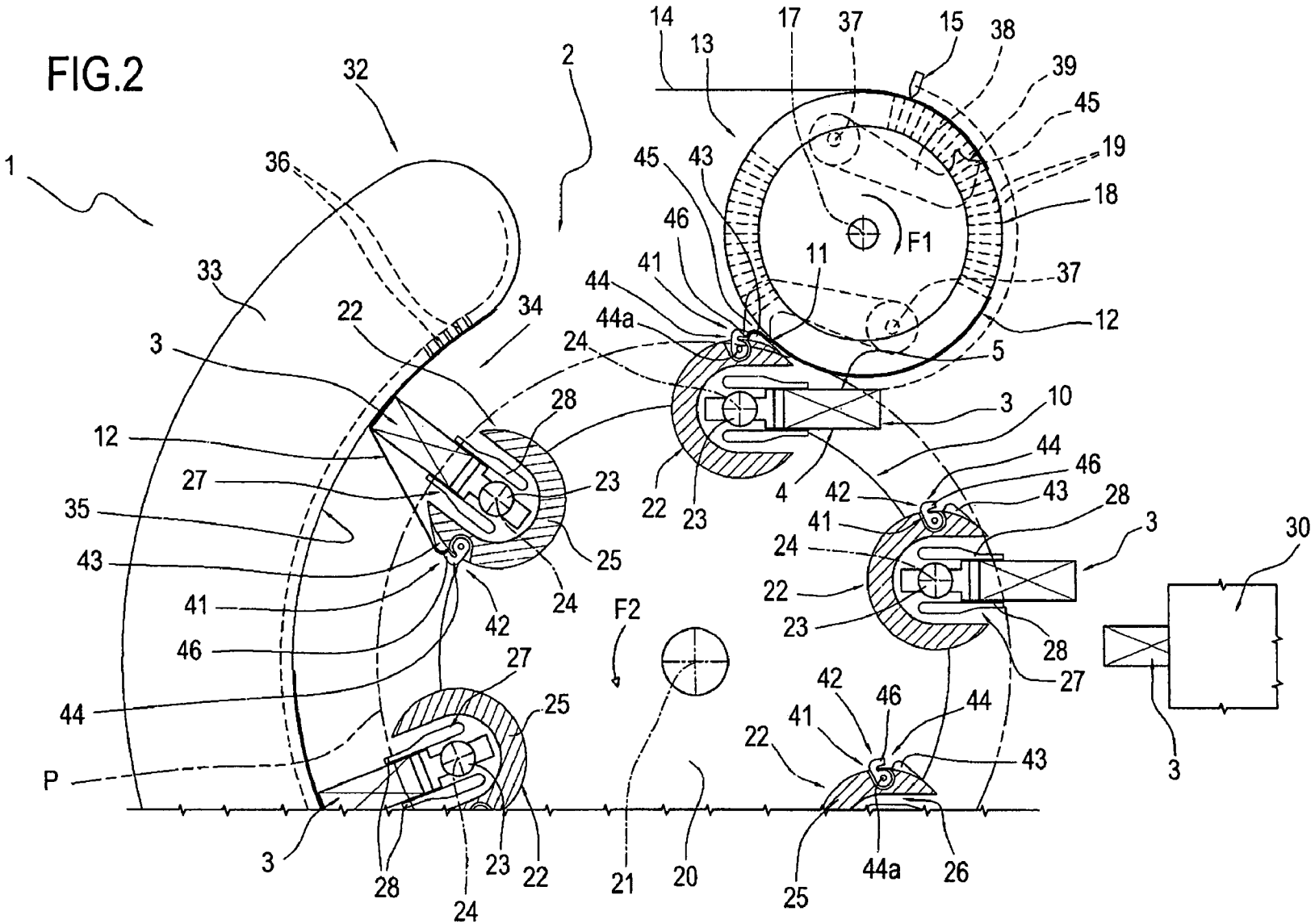

The arms 38 and the relative pivots 37 provide means by which to transfer the leaves 12 of wrapping material. With the vacuum roller 16 set in rotation, each arm 38 in turn is caused by actuator means (not shown) to pivot between a first position retracted entirely within the tubular wall 18 (FIG. 1), and a second position, assumed at the assembly station 11 (FIGS. 2 and 4), in which the relative free ends 39 project through the aforementioned openings 40, externally of the tubular wall 18.

Immediately upstream of the slot 29, considered relative to a first direction of rotation indicated by the arrow denoted F3, each mechanism 22 is equipped externally with means 41, consisting in gripper means 42, by which to restrain one end of a leaf 12 of material.

Such gripper means 42 comprise a jaw 43 of curved profile anchored rigidly to the cylindrical body 25, and a movable jaw 44 mounted freely to a pivot 44*a* disposed parallel to the axis 24 of the mechanism, which is caused by actuator means (not shown) to alternate between an open position, and a closed position of contact with the rigidly anchored jaw 43 (FIG. 4); this same fixed jaw 43 functions also as a locating element for the aforementioned free end 39 of the arm 38 when in the second position.

Figure 5:
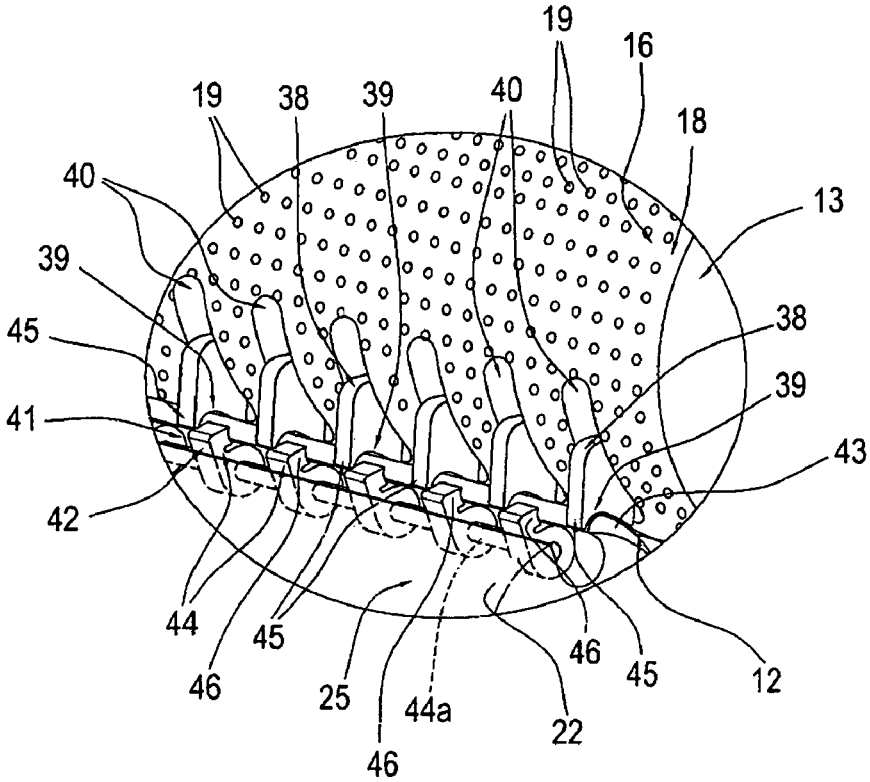
FIG. 5 is a detail of FIG. 4, illustrated schematically and in perspective.

As illustrated in FIG. 5, the profile presented by the free end 39 of the arm 38 and the profile presented by the free end of the movable jaw 44 are matched to that of the jaw 43 associated rigidly with the body 25. More exactly, these same free ends are identifiable as pluralities of teeth, denoted 45 and 46 respectively, arrayed parallel with the axis 24 of the cylindrical body 25 and offset one from another in such a way that the arm 38 and the jaw 44 are able to close on the fixed jaw 43, sequentially or simultaneously, without mutual interference.

In operation, with the drum 20 set in rotation, each support mechanism 22 is brought in turn to the infeed position 31.

When occupying this position 31, the mechanism 22 is set angularly on the relative axis 24 in such a way that the axial lateral opening 26 will be directed toward the feed unit 30 with the gripper jaws 28 spread apart to accommodate an advancing packet 3, which is insertable to the point where a leading flank face 6 engages in contact with the back wall of the slot 29.

The jaws 28 then close, securing the packet 3 firmly on the rotating drum 20.

Along the segment of the feed path P corresponding substantially to a rotation of the drum 20 through 90° between the infeed position 31 and the assembly station 11, the mechanism 22 in question pivots on its axis 24 in a direction, denoted F3, opposite to the direction of rotation F2 of the drum 20, so as bring the packet 3 into a position of minimum radial encumbrance, that is to say with the larger side walls 4 and 5 disposed approximately parallel to the plane of tangency between the drum 20 and the vacuum roller 16.

This position of minimum encumbrance is maintained as the mechanism 22 passes through the assembly station 11, where the end of the leaf 12 of wrapping material will be transferred from the roller 16 to the drum 20.

During the course of this transfer step, the tangential velocity of the cylindrical body 25, and therefore of the associated gripper means 42, is controlled in such a way as substantially to match the tangential velocity of the vacuum roller 16.

The vacuum roller 16 is timed relative to the wrapping drum 20 in such a way that the openings 40 occupied by the projecting teeth 45 of each arm 38 will reach the assembly station 11 simultaneously with the gripper means 42, and accompanied by the leading edge of a leaf 12 positioned on the surface of the roller 16.

Figure 4:
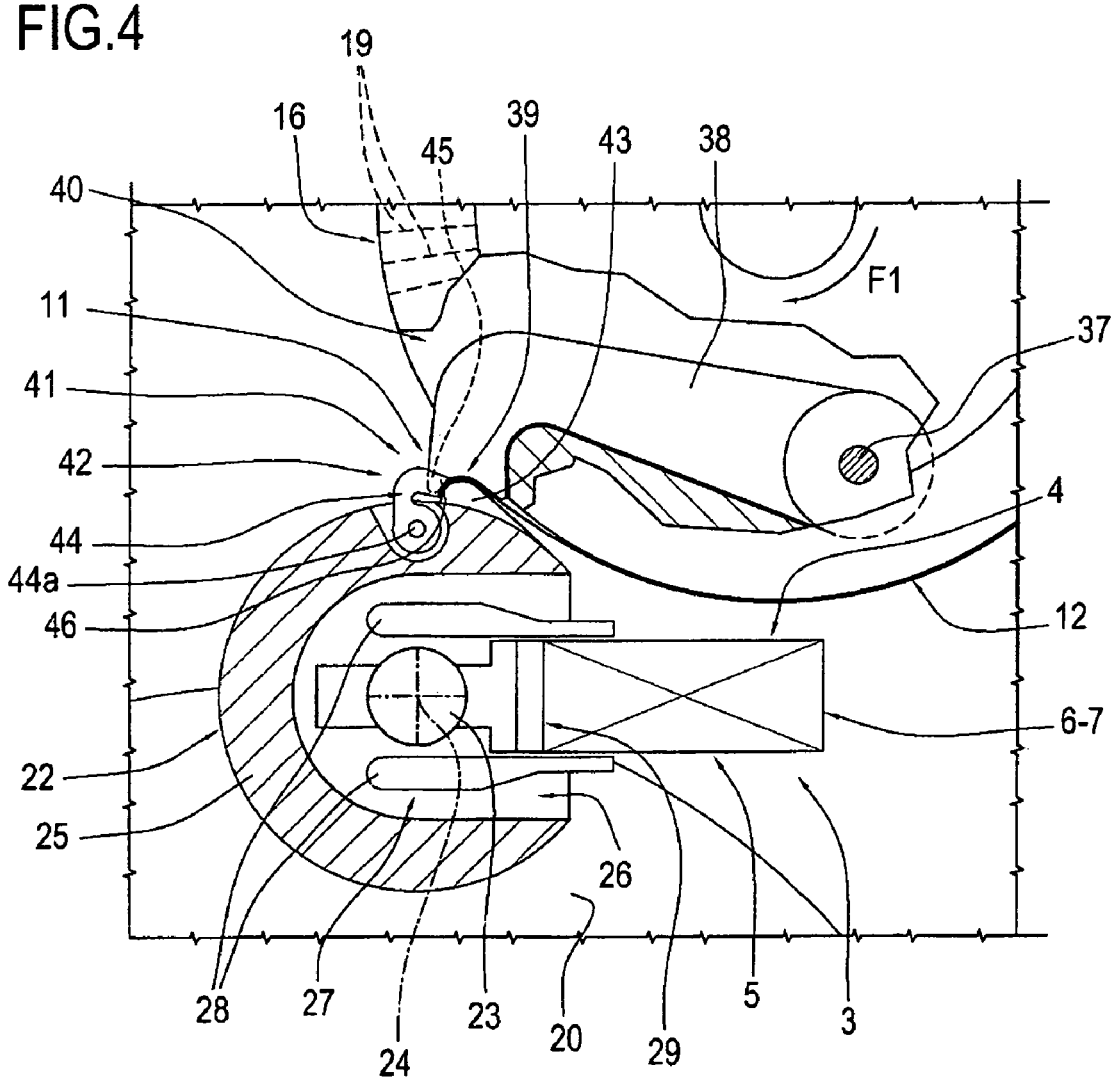
FIG. 4 shows an enlarged detail of FIG. 2, in a front elevation view.

At this point, the arm 38 rocks anticlockwise on its pivot 37, as viewed in FIG. 4, with the result that the leading edge of the leaf 12 will be bent perpendicularly to the feed direction F1 and pinned against the fixed jaw 43.

During a momentary pause in the relative movement of the vacuum roller 16 and the drum 20, with the leading edge of the leaf 12 held fast, that is to say before the arm 38 returns to its retracted position, the movable jaw 44 will close on the fixed jaw.

The finger-like ends of the arm 38 and of the movable jaw 44 are embodied in such a way that both can interact simultaneously with the leading edge presented by the leaf 12 of wrapping material, and thus keep it permanently under control.

As discernible from the foregoing, the arm 38 constitutes means by which to divert and immobilize the leading edge of the leaf 12 and, once the movable jaw 44 has closed, will pivot back to its retracted position entirely within the tubular wall 18 of the roller 16.

Meanwhile, having progressed beyond the assembly station 11, the mechanism 22 advances toward the fixed folding means 32, pivoting anticlockwise as viewed in FIG. 1 (arrow F4), and reaches the entry to the channel 34, where the packet 3 reassumes a position of maximum radial encumbrance relative to the drum 20.

During this step in which the drum 20 and the mechanism 22 in question rotate simultaneously, the leaf 12 of wrapping material separates by degrees from the surface of the vacuum roller 16 and is retained immediately, by the force of suction, on the surface 35 of the mantle 33.

At the same time, as a result of the mechanism 22 and the packet 3 rotating in the direction of the arrow denoted F4, the leaf 12, which continues to be tensioned by the aspirating action of the vacuum roller 16, is caused progressively to cling to a radially outermost flank face 6 or 7 of the packet 3 at a position denoted 47, located internally of the channel 34 and diametrally opposite to the infeed position 31.

The steps by which the leaf 12 is formed into a tubular wrap will be completed in familiar fashion, neither described nor illustrated herein, downstream of the aforementioned position 47.

Whilst the foregoing description relates to a cellophaner or overwrapper, it would be applicable equally in the case of a cigarette packer; in this instance, self-evidently, the wrapping drum 20 will be supplied by the feed unit 30 not with packets of cigarettes, but with groups of cigarettes enveloped previously in wrappers of metal foil paper, and the leaves 12 of wrapping material will consist of paper rather than clear plastic.

It will be seen that the step of transferring the leaf 12 from the roller 16 to the rotating drum 20 occurs, in accordance with the present invention, at a moment of zero relative velocity between these same two components and with the leaf 12 of material continuously under control, its leading edge pinned between the arm 38 and the fixed gripper jaw 43, and thereafter, in unbroken sequence, between the movable jaw 44 and the fixed jaw 43 of the gripper means 42.

Figure 6:
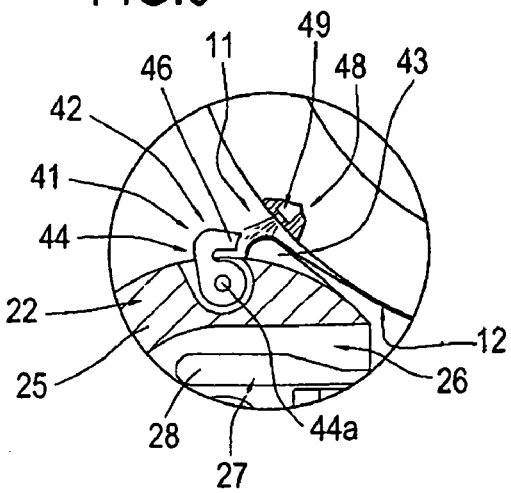
FIGS. 6 and 7 show an alternative embodiment of the detail in FIG. 4, viewed schematically in a front elevation view and illustrated in two successive operating steps.
Figure 7:
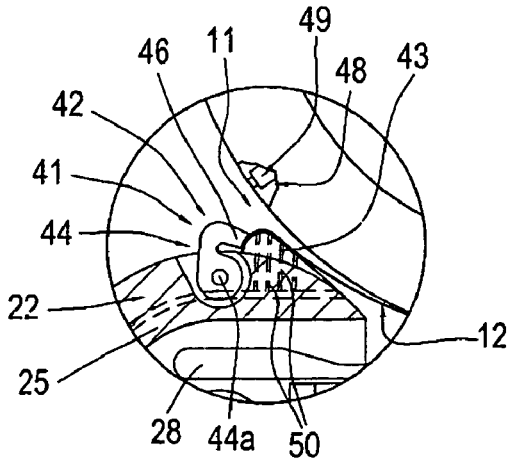

Moreover, and as illustrated in FIGS. 6 and 7, the arms 38 might be replaced by pneumatic means 48 comprising a plurality of nozzles 49 arrayed parallel with the axis 17 of the roller 16 and oriented in such a manner as to divert the leading edge of the leaf 12 toward the fixed jaw 43.

Finally, as illustrated in FIG. 7, the restraint means aforementioned might comprise suction holes 50, coinciding with the fixed gripper jaw 43, connected to a source of negative pressure (not illustrated) and configured in such a way as to retain the leading edge of the leaf 12 diverted by the nozzles 49 or by the arm 38.

The present invention relates also to a method of wrapping tobacco products, of which the steps are readily discernible from the content of the foregoing specification.

What is claimed:

1. A wrapping unit for tobacco products, comprising:

a rotating drum furnished peripherally with a plurality of carrier mechanisms rotatable about axes parallel to the axis of the drum, by which products are supported and carried through an assembly station together with leaves of wrapping material;

a rotating conveyor supplying such leaves, rotatable about an axis parallel to the axis of the drum and revolving substantially tangential to the rotating drum at the assembly station, wherein the rotating conveyor comprises a transfer mechanism by which single leaves of material are transferred to each carrier mechanism; the transfer mechanism including a diverting mechanism by which to divert a leading edge of the leaf away from the rotating conveyor and toward a restraint mechanism, associated with the carrier mechanism, by which the edge of the leaf is restrained; and wherein the wrapping unit is configured to control a tangential velocity of the carrier mechanisms when passing through the assembly station to be substantially the same as a tangential velocity of the rotating conveyor.

2. A unit for wrapping tobacco products as in claim 1, wherein the diverting mechanism comprises a rocking arm rocking on a pivot parallel to the axis of the drum between a first and a second position in such a way as to transfer the leading edge of the leaf from the rotating conveyor to the restraint mechanism.

3. A unit for wrapping tobacco products as in claim 1, wherein the diverting mechanism comprises a rocking arm rocking on a pivot parallel to the axis of the drum between a first and a second position, and the restraint mechanism is embodied as a gripper mechanism comprising a first jaw movable between an open position, and a closed position holding the leaf in contact with a second jaw, the second jaw functioning also as a locating element against which the rocking arm registers when in the second position.

4. A unit for wrapping tobacco products as in claim 3, wherein ends of the rocking arm and the movable jaws are furnished each with a plurality of respective teeth arrayed parallel to the axis of the carrier mechanism and offset one from another in such a way that the teeth of both sets are able to close on the second jaw without mutual interference.

5. A unit for wrapping tobacco products as in claim 4, wherein the pneumatic mechanism comprises a plurality of nozzles connected to a source of compressed air.

6. A unit for wrapping tobacco products as in claim 4, wherein the restraint mechanism associated with the carrier mechanism comprises a pneumatic mechanism.

7. A unit for wrapping tobacco products as in claim 1, wherein the diverting mechanism is embodied as a pneumatic mechanism acting on the leading edge of the leaf of material at the assembly station to transfer the leading edge from the rotating conveyor to the restraint mechanism.

8. A unit for wrapping tobacco products as in claim 1, forming part of at least one of an overwrapping machine or a cellophaner.

9. A unit for wrapping tobacco products as in claim 1, forming part of a packer machine.

* * * * *